United States Patent [19]

Knudsen

[11] 4,022,124

[45] May 10, 1977

[54] PRINTING MACHINE

[75] Inventor: David S. Knudsen, St. Louis, Mo.

[73] Assignee: McKenna Equipment Company Inc., St. Louis, Mo.

[22] Filed: Oct. 29, 1975

[21] Appl. No.: 626,790

[52] U.S. Cl. ..... 101/36; 101/348; 101/350

[51] Int. Cl.[2] ..... B41F 17/00

[58] Field of Search ..... 101/36, 6, 37, 157, 101/348, 349, 350, 364, 367

[56] References Cited

UNITED STATES PATENTS

| | | | |
|---|---|---|---|
| 2,186,555 | 1/1940 | Phillips | 101/36 |
| 2,213,419 | 9/1940 | Taylor | 101/350 |
| 2,470,075 | 5/1949 | Robbins | 101/36 |
| 2,869,454 | 1/1959 | Lang | 101/348 X |
| 3,468,251 | 9/1969 | Brookmuller | 101/350 |
| 3,603,250 | 9/1971 | Knudsen | 101/36 |
| 3,613,578 | 10/1971 | Heurich | 101/350 |
| 3,756,152 | 9/1973 | Abler | 101/350 |
| 3,786,746 | 1/1974 | Roberts | 101/350 |
| 3,835,597 | 9/1974 | Wasil | 101/348 X |
| R18,856 | 6/1933 | Weiss | 101/157 |

*Primary Examiner*—Edward M. Coven
*Attorney, Agent, or Firm*—Gravely, Lieder & Woodruff

[57] ABSTRACT

A machine for printing letters, numbers, symbols and the like on banding or other flexible material of extended length includes a drive wheel and a printing wheel, as well as pressure rollers for pressing the banding against the two wheels. The drive wheel is driven by the banding as the banding is drawn through the machine, and the printing wheel is connected to the drive wheel through a belt such that the two wheels have the same peripheral velocity. Thus, the printing wheel, which has raised characters around its periphery, rotates as the banding passes over it. The raised characters of the printing wheel further pass over the periphery of an ink transfer wheel, all but a small segment of which is contained within a sealed case of an inking unit. The surface of the ink transfer wheel is pitted, and where that wheel emerges from the case, seals are provided to form a vapor barrier which isolates the interior of the case from the surrounding atmosphere. Within the case an ink pick-up wheel lifts ink from a reservoir at the bottom of the case to the ink transfer wheel, from which the ink is transferred to the raised characters on the printing wheel and thence to the banding. The belt further drives the ink pick-up wheel and the ink transfer wheel. A release mechanism is provided which, when operated, withdraws the pressure rollers from the drive and printing wheels, moves the ink transfer wheel away from the printing wheel, and creates slack in the belt.

16 Claims, 8 Drawing Figures

PRINTING MACHINE

BACKGROUND OF THE INVENTION

This invention relates in general to printing machines, and more particularly to a machine for printing letters, numbers, symbols, and the like on extended lengths of material such as banding.

Plastic banding, because of its light weight, high strength, and low cost is used extensively for holding packages and bundles together. Ofter the most convenient place to print information which accompanies a package or bundle is on the banding. For example, in the case of goods joined together in a bundle, an identifying or shipping mark places on the goods themselves will soil those goods and dimish their value.

Plastic banding, however, does not absorb ink in the manner that paper or other cellulose materials do. As a result, extremely quick drying ink must be employed. These inks are of course highly volatile, and indeed most dry within one to five seconds after being applied to a surface.

Heretofore devices have been developed for printing characters on tape, but these devices are incapable of printing with highly volatile inks. One such device is disclosed in U.S. Pat. No. 3,603,250 issued Sept. 7, 1971.

SUMMARY OF THE INVENTION

One of the principal objects of the present invention is to provide a machine capable of printing letters, numbers, symbols and the like on material of extended length. Another object is to provide a machine of the type stated which is capable of printing with extremely fast drying ink. A further object is to provide a machine of the type stated which is ideally suited for printing on plastic bonding. An additional object is to provide a machine of the type stated which is powered by the banding itself and prints clearly on the banding even though the banding is advanced incrementally through the machine. These and other objects and advantages will become apparent hereinafter.

The present invention is embodied in a printing machine including drive and printing wheels over which material extends and a pressure roller for urging the material against the drive wheel. The two wheels are connected together to rotate in unison. The printing wheel has raised characters which move over an inking wheel of an inking means so that ink is applied to the raised characters and thence to the material. Release means, when operated, simultaneously moves the pressure roller away from the drive wheel and the ink transfer wheel away from the printing wheel. The invention also resides in the inking unit which in addition to the ink transfer wheel includes a sealed case through which a small segment of the ink transfer wheel extends. Seal means are provided between the case and wheel to isolate the interior of the case from the surrounding atmosphere. Means are provided within the case for applying ink to the peripheral surface of the ink transfer wheel. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 8:
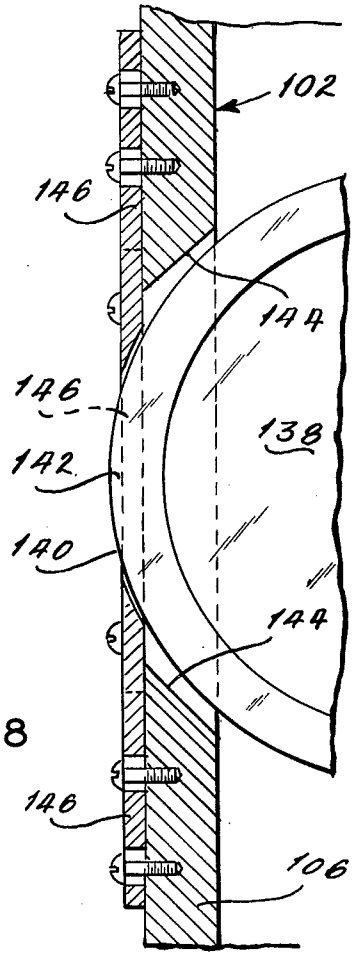
FIG. 8 is a fragmentary sectional view of the inking unit taken along line 8—8 of FIG. 2.

Referring now to the drawings (FIG. 1), A designates a machine for printing letters, numbers, symbols and the like on banding B which passes through the machine A. The printing machine A is used in conjunction with a banding machine (not shown) which applies the banding B around bundles or packages and in so doing draws the banding B through the machine A, often incrementally, that is, in a series of starts and stops.

The machine A includes a base structure in the form of generally rectangular housing 2 (FIGS. 1 and 2) which is preferably cast from suitable metal such as stainless steel and has a back wall 4 with two sidewalls 6 and 8, a top wall 10, and a bottom wall 12 projecting forwardly from it. The walls 6, 8, 10 and 12 are joined together in a rectangular configuration and interior of this configuration is closed by a clear plastic cover 14 which is hinged to the top wall 10. The back wall 2 has a retangular rear wall 16 (FIG. 3) projected rearwardly from it to form another cavity which is smaller than the cavity defined by the walls 6, 8, 10 and 12, and this other cavity is closed by another clear plastic cover 18 which is hinged to the upper segment of the wall 16. The two sidewalls 6 and 8 have elongated apertures 20 through which the banding B passes. The housing 2 is mounted on the banding machine or some other suitable supporting structure with the apertures 20 aligned with the banding B so that the banding B enters the housing 2 through the aperture 20 in the wall 8 and leaves through the aperture 20 in the wall 6.

Extending through the interior of the housing 2 from one aperture 20 to the other are a pair of parallel guide strips 22 which by means of screws 23 (FIGS. 1 and 2) are secured to each other. The two strips 22 are supported on mounting blocks 24 (FIGS. 2 and 5) attached to the back wall 4. The lower of the two guide strips 22 is relieved adjacent one edge to form a channel 26 (FIG. 2) which aligns with the apertures 20. The channel 26 accommodates the banding B. The upper strip 22 is provided with a lip which turns downwardly over the edge of the lower strip 22 and closes the side of the channel 26. The holes in the upper strip 22 through which the machine screws 23 extend are elongated in the transverse direction so that the width of the channel 26 may be varied to accommodate banding of different width. Near each elongated aperture 20, the two strips 22 are provided with aligned cutouts 28 which are slightly wider than the banding channel 26.

Directly below the pair of aligned cutouts 28 located next to the sidewall 8 is a drive shaft 30 (FIGS. 1 and 2) which extends through a bearing 32 set into the rear wall 4. To the front of the rear wall 4 the drive shaft 30 is fitted with a drive wheel 34 which extends upwardly into the output 28 of the lower guide strip 22. Indeed, the drive wheel 34 projects into the channel 26 to enable its peripheral surface, which is knurled to contact the banding B within the channel 26. The drive wheel 34 is about as wide as the cutout 28 and hence occupies almost the entire cutout 28. On the other side of the rear wall 4 (FIG. 2), the shaft 30 is fitted with a pulley 36.

At the other side of the housing 2 another shaft 38 (FIGS. 1 and 2) extends through a bearing 40 in the back wall 4, the shaft 38 being directly below the other pair of cutouts 28 in the guide strips 22. The shaft 38 has a flange 42 (FIG. 2) located immediately beyond the bearing 40, and this flange has a pair of locating pins 44 extended axially from it beyond the main body of the shaft 38. The portion of the shaft 38 projecting axially beyond the flange 42 carries a printing wheel 46 having small offset apertures for receiving the locating pins 44. Thus, the pins 44 lock the wheel 46 on the shaft 38 and prevent the wheel 46 from slipping relative to the shaft 38. The printing wheel 46 is retained on the shaft 38 by a thumb nut 48 which threads over the end of the shaft 38.

Figure 3:
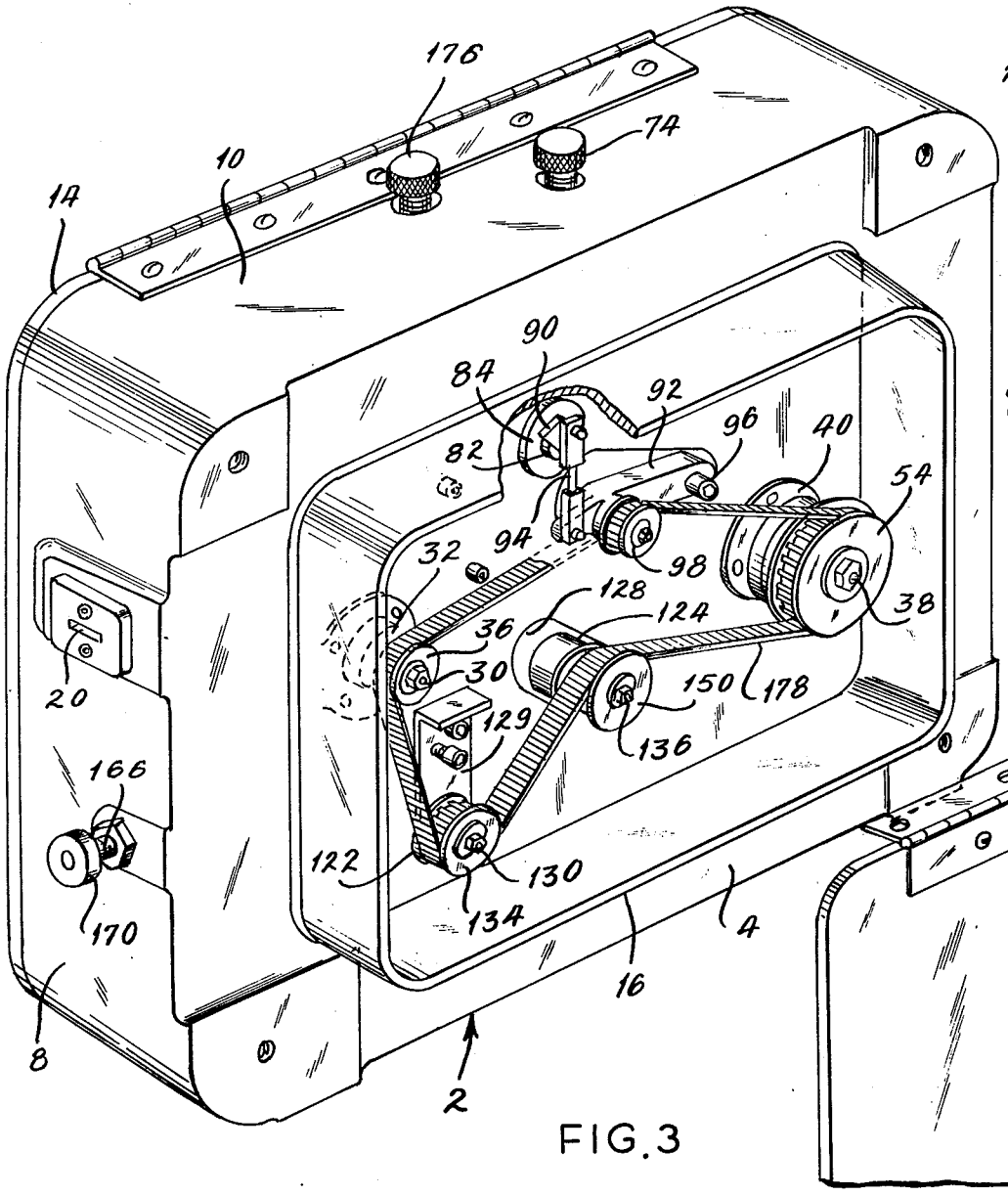
FIG. 3 is a perspective view showing the rear of the printing machine with the release mechanism in its operating position.

The diameter of the printing wheel 46 is twice that of the drive wheel 34, and like the drive wheel 34, it extends into the channel 26 at the other pair of cutouts 28. Actually, the printing wheel 46 is grooved at its periphery, and the groove contains a band 50 having raised characters 52. It is the characters 52 which form the periphery of the wheel 46 and project into the banding channel 26 where they bear against the lower face of the banding B. The band 50 and the raised characters 52 on it are formed from an elastomeric material. To the rear of the back wall 4 the shaft 38 is fitted with a pulley 54 (FIG. 3).

Figure 4:
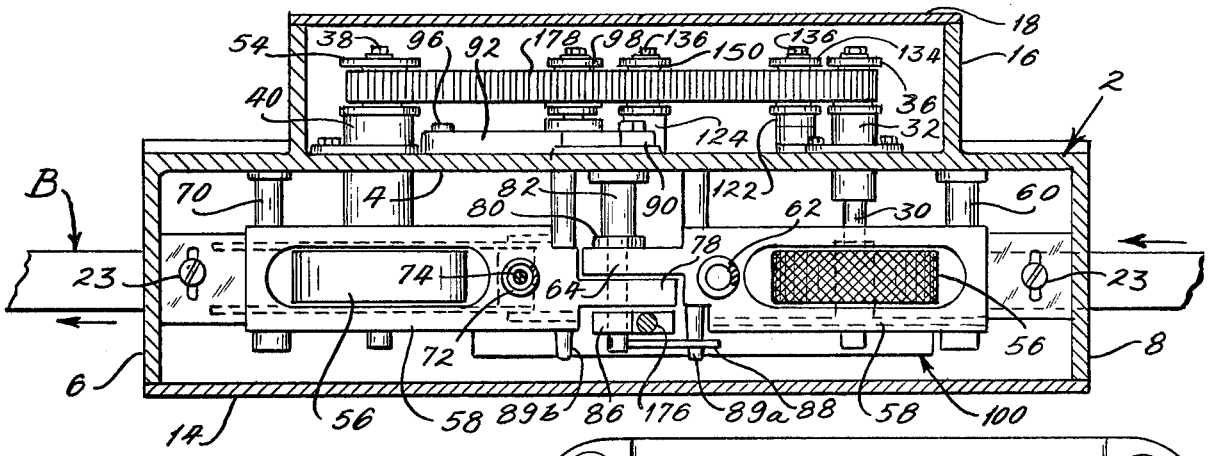
FIG. 4 is a sectional view taken along line 4—4 of FIG. 2 and showing the release mechanism and roller carriers.

The banding B is pressed snugly against the knurled surface on the drive wheel 34 by a pressure roller 56 which extends into the cutout 28 in the upper guide strip 22. The roller 56 revolves within a roller carrier 58 which pivots about a pivot pin 60 threaded into the back wall 4 near the sidewall 8. On the opposite side of the roller 56, the carrier 58 is forced downwardly by a coil-type compression spring 62 which is interposed between the carrier 58 and the top wall 10 of the housing 2. Beyond the spring 62, the carrier 58 is provided with a narrow finger 64 (FIG. 4) which functions as a cam follower Similarly, at the other pair of cutouts 28 the banding B is pressed snugly against the raised characters 52 on the printing wheel 46 by another pressure roller 66 (FIGS. 1 and 5) which is mounted in a carrier 68, and the carrier 68 in turn pivots about a pivot pin 70 threaded into the back wall 4 adjacent to the sidewall 6. On the other side of the pressure roller 66 a coil-type compression spring 72 is interposed between the top wall 10 of the housing 2 and the pressure roller 66 and an adjusting screw 74 is in turn extended through spring 72. The adjusting screw 74 is threaded into the top wall 10 of the housing 2, and furthermore is extended completely through the carrier 68, beyond which it is fitted with a nut 76. When the screw 74 is backed off, it elevates the roller carrier 66 in opposition to the force exerted thereon by the spring 72. Thus, the screw 74 precisely controls the position of the pressure roller 66 and the distance it will deflect the banding B into the elastomeric raised characters 52 of the printing wheel 46. The roller carrier 68 has a narrow finger 78 (FIG. 4) extended beyond the adjusting screw 74, and the finger 78 is located beside the narrow finger 64 of the other roller carrier 58. It likewise serves as a cam follower.

The narrow fingers 64 and 78 of the two roller carriers 58 and 68 rest on an elavating cam 80 (FIGS. 1, 4 and 5) which is secured to a cam shaft 82 forming part of a release mechanism. The cam shaft 82 in turn extends through a bearing 84 (FIG. 2) in the back wall 4. Thus, when the shaft 82 is turned in the proper direction, the elevating cam 80 will raise the fingers 64 and 78 which bear against it, and this will have the effect of elevating the pressure rollers 56 and 66 away from the drive wheel 34 and the printing wheel 46, respectively. Outwardly from the elevating cam 80, the shaft 82 is provided with a deflecting cam 86, and near its forward end the shaft 82 is fitted with an operating lever 88 for rotating the shaft 82 and the cams 80 and 86 on it between operating and release positions. In the operating position (FIG. 1) the elevating cam 80 is backed off from the fingers 64 and 78 and the lever 88 rests against a stop 89*a* projected from the back wall 4. In the release position (FIG. 5) the cam 80 bears against the fingers 64 and 78 and elevates the pressure rollers 56 and 66. The lever 88 rests against a similar stop 89*b*. In terms of lever movement of the stops 89*a* and 89*b* are about 170° apart.

Figure 6:
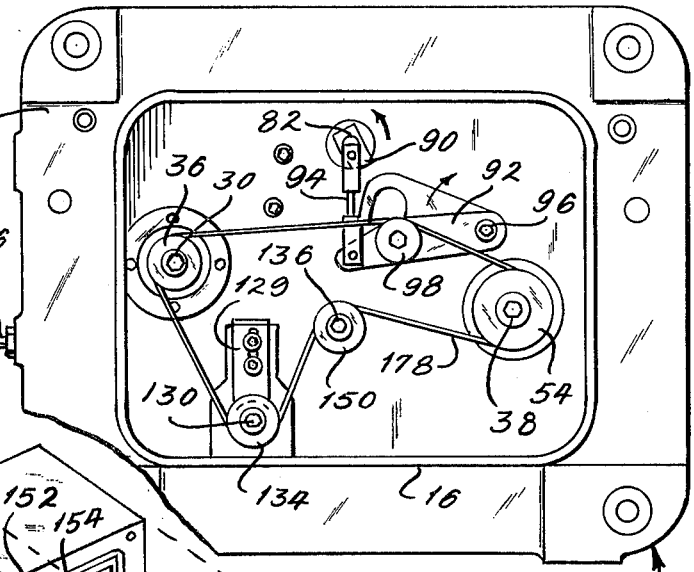
FIG. 6 is a fragmentary elevational view showing the rear of the printing machine with the release mechanism in its release position.

The cam shaft 82 furthermore projects beyond the back wall 4 (FIGS. 3 ad 6) where it is fitted with a crank arm 90 which in turn is connected to one end of an idler carrier 92 through an adjustable connecting link 94. The idler carrier 92 extends generally horizontally along the back wall 4 and pivots at its other end about a pivot pin 66. The idler carrier 92 carries an idler pulley 98 which aligns with and is located above the pulleys 36 and 54 for the drive wheel 34 and printing wheel 46, respectively. The angle of the crank arm 90 is such that when the cam shaft 82 is in its operating position, the arm 90 is slightly over top center (FIG. 3) so that any downward force thereon is resisted by the stop 89*a*. As the cam shaft 82 rotates to its release position the crank arm 90 moves over top center and then downwardly and this depresses the idler carrier 92 (FIG. 6). This has the effect of lowering the idler pulley 98 relative to the pulleys 36 and 54.

Figure 1:
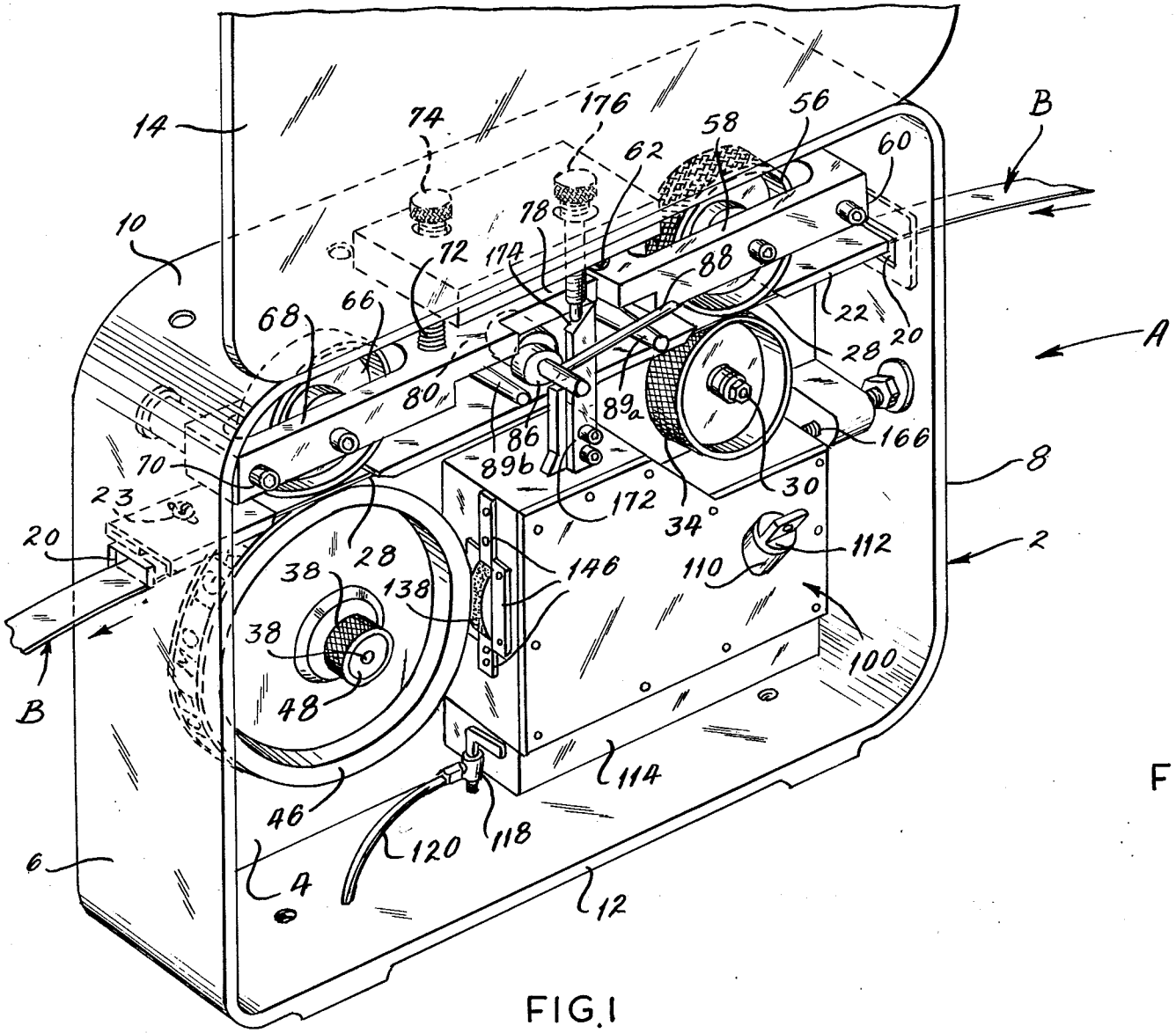
FIG. 1 is a perspective view showing the front of the printing machine of the present invention with its release mechanism in the operating position.
Figure 2:
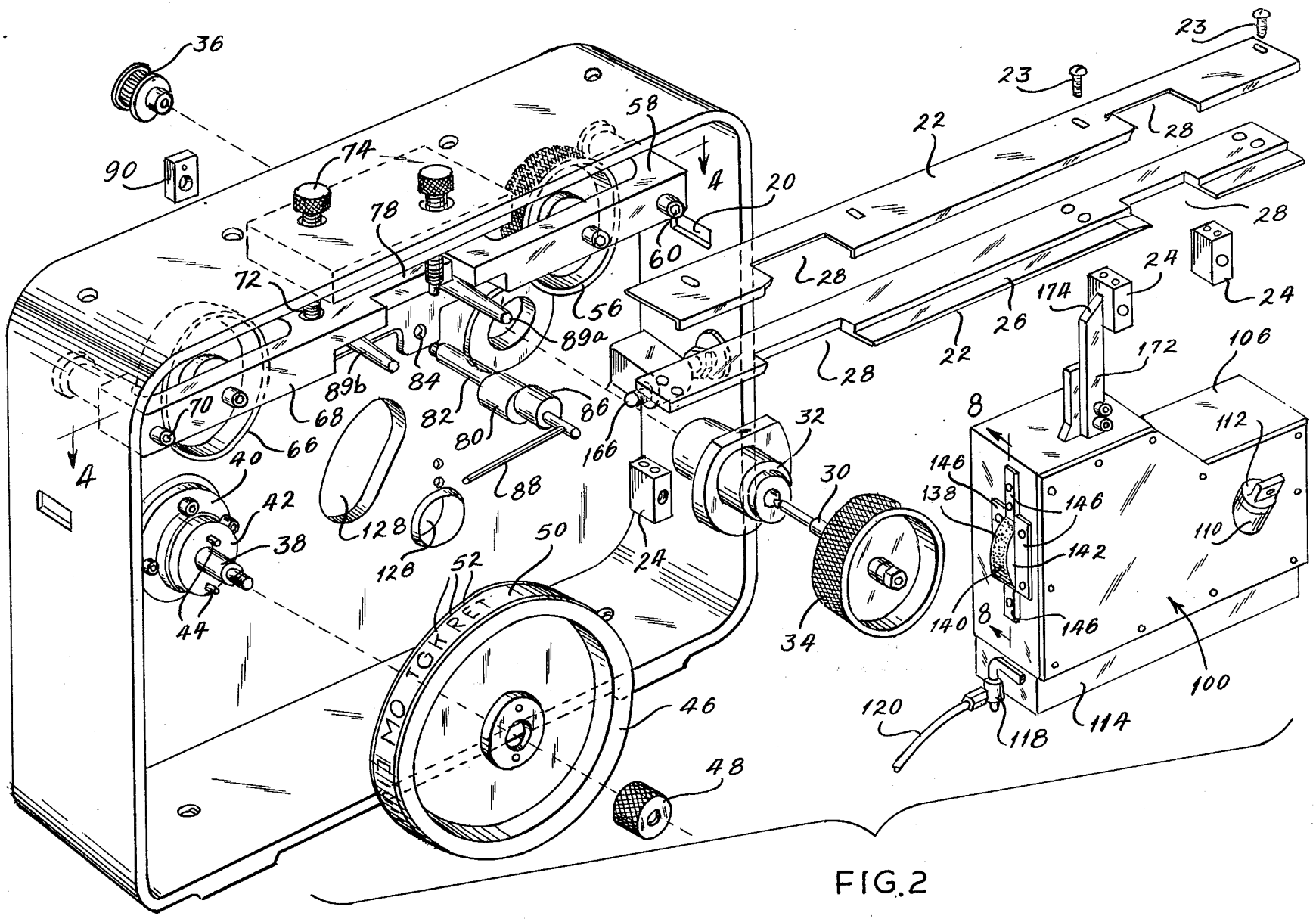
FIG. 2 is a perspective view similar to FIG. 1, but is partially exploded to show the drive and printing wheels, the release mechanism, and the inking unit in greater detail.
Figure 5:
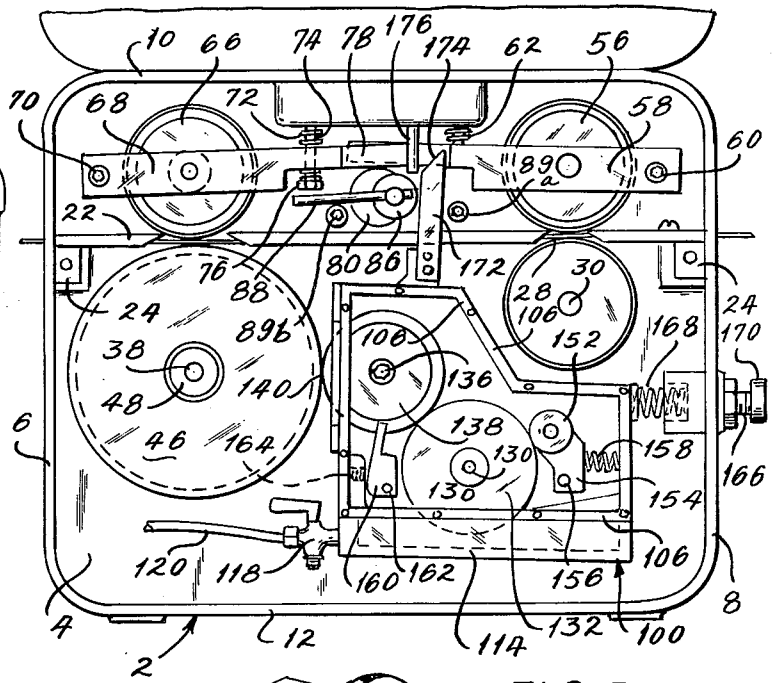
FIG. 5 is an elevational view showing the front of the printing machine with release mechanism in its release position and the interior of the inking unit exposed.

In addition to the foregoing components, the printing machine A includes an inking unit 100 which is located within the housing 2 generally beneath the drive wheel 34 and to the side of the printing wheel 46 (FIGS. 1 and 5). The inking unit 100 supplies the proper amount of ink to the raised characters 52 on the printing wheel 46 which in turn transfer the ink to the banding B in the configuration of the characters 52. In this regard, the quantity of ink supplied to the printing wheel 46 is quite critical, particularly in the case of highly volatile inks which dry in a matter of seconds. If too much ink is supplied, the ink smears on the banding B. On the other hand, if too little ink is supplied illegible markings are imparted to the banding B.

Figure 7:
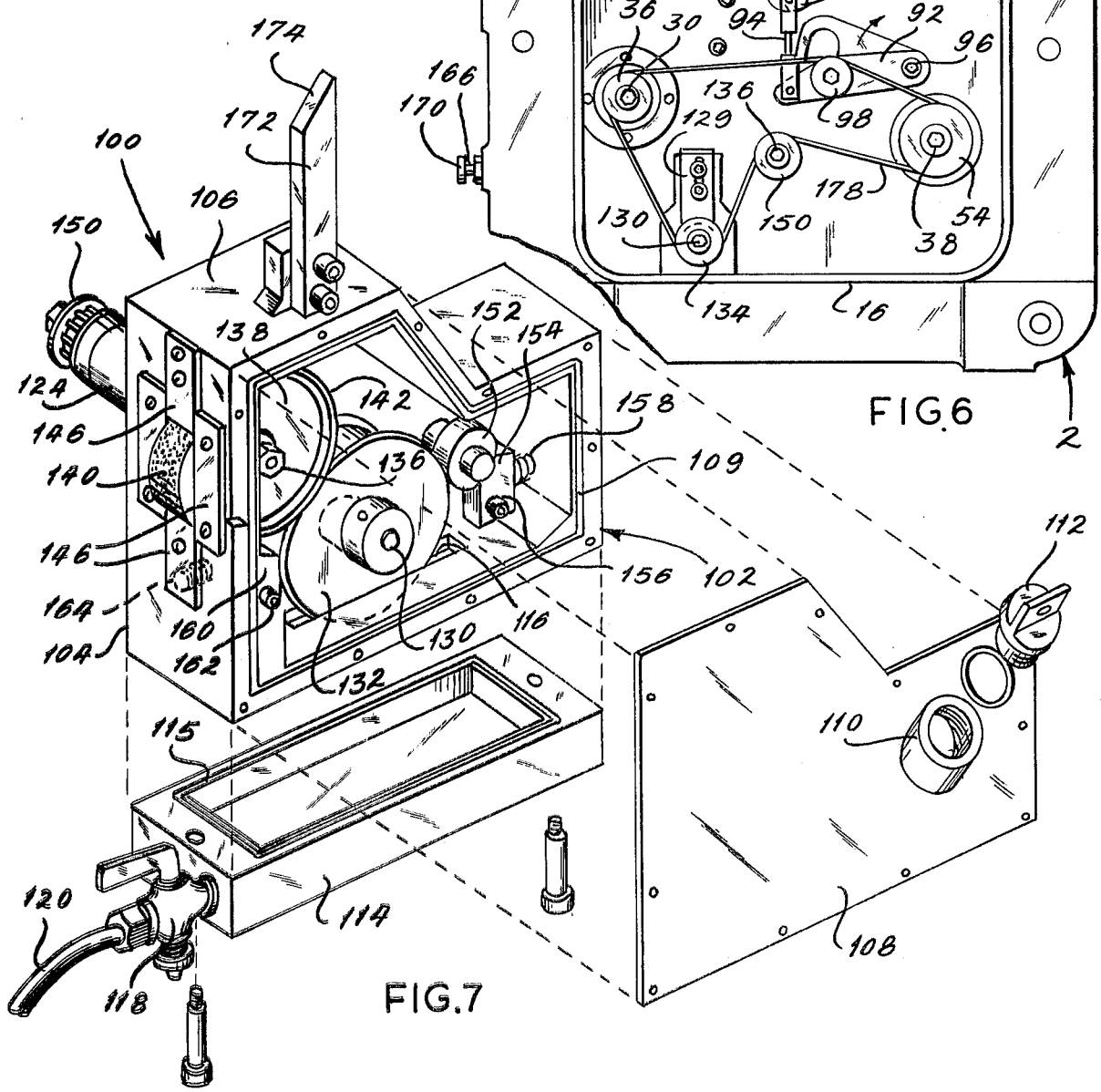
FIG. 7 is an exploded perspective view of the inking unit for the printing machine.

The inking unit 100 includes (FIG. 7) a sealed case 102 which is preferably cast from a metal such as brass that does not oxidize or corrode easily in the presence of the volatile ink. The sealed case 102 has a back wall 104 which is presented toward the back wall 4 of the housing 2 and a peripheral wall 106 which is formed integral with the back wall 104 and surrounds a sealed space within the case 102. While one end of the sealed space is closed by the back wall 104, the opposite end is closed by a cover plate 108 which is secured to the peripheral walls 106 by screws and sealed against leakage by a large O-ring seal 109 fitted into a groove within the edges of the peripheral wall 106. The cover plate 108 has a filling port 110 therein, and the port 110 is normally closed with a plug 112 which fits therein. The plug 112 carries an O-ring seal. Fitted against the lower portion of the peripheral wall 106 on the case 102 is an ink reservoir 114 which is preferably formed from a plastic such as Delrin, the reservoir 114 beig also sealed to the case by a large O-ring seal 115 which is contained within a groove formed in the upper surface of the reservoir 114. The reservoir 114 has an upwardly opening cavity in which the volatile ink is contained, and this cavity communicates with the hollow interior of the sealed case 102 through a slot 116 formed in the bottom of the peripheral wall 106. The cavity of the reservoir 114 is supplied with ink through a valve 118 which in turn is connected with an ink supply hose 120. It may also be filled through the filling port 110.

The back wall 104 of the sealed case 102 has a pair of cylindrical bosses 122 and 124 (FIG. 3) projected rearwardly from it with the former being located lower than the latter. The cylindrical oss 122 fits into a bore 126 (FIG. 2) within the back wall 4 of the housing 2 and serves as a pivot about which the entire inking unit 100 rotates a few degrees in each direction to enable it to be positioned precisely with respect to the printing wheel 46. Since positioning of the inking unit is important, close tolerances are held in the dimensions of the boss 122 and the bore 126 and the clearance between the two is no greater than 0.002 inches. The other boss 124 is received in an oblong aperture 128 (FIG. 2) within the back wall 4, and the configuration of that aperture is such that it permits the entire seal case 102 to rotate a few degrees. To prevent the inking unit 100 from moving forwardly, the back wall 4 has a locking tab 129 (FIGS. 3 and 6) which projects into an annular groove on the boss 12. The tab 129 may be withdrawn from the groove to permit removal of the inking unit 100.

Extended through the lower boss 122 is a shaft 130 which rotates in bearings within the boss 12. The shaft 130 carries an ink pick-up wheel 132 (FIGS. 5 and 7) which is located within the interior of the case 102 and is large enough in diameter to extend through the slot 116 in the case 102 and into the ink within the reservoir 114. The wheel 132 is quite narrow and is preferably made from a plastic such as Delrin which remains chemically stable in the presence of the volatile ink. The other end of the shaft 130 is located within the cavity formed by the rear wall 16, and this end of the shaft is fitted with a pulley 134 (FIG. 3) which aligns with the pulleys 36, 54 and 98.

The cylindrical boss 124 likewise has a shaft 136 extended through it, and this shaft rotates in bearings within the boss 124. The end of the shaft 136 is located within the sealed interior of the case 102 and has an ink transfer wheel 138 (FIGS. 5 and 7) mounted on it, and the periphery of this wheel passes close to the periphery of the ink pick-up wheel 132. Actually, the two wheels 132 and 138 are spaced about 0.0005 to 0.0010 inches apart to avoid grooving the transfer wheel 138. The spacing, however, is close enough to permit ink which is on the pick-up wheel 132 to be transferred to the ink transfer wheel 138. The ink transfer wheel 138 has a cylindrical peripheral surface 140 which is 6 to 10 and preferably 8 times wider than the ink pick-up wheel 132, and this surface is bounded by side edges 142 which lie in parallel planes perpendicular to the axis of the shaft 136. The wheel 138 projects through a rectangular apertures 144 (FIG. 8) in that portion of the peripheral wall 106 which faces the printing wheel 46. Indeed, the peripheral surface 140 of the ink transfer wheel 138 contacts the raised characters 52 on the printing wheel 46 (FIGS. 1 and 5). The rectangular aperture 144 is lined with four small seal plates 146 which are adjustable inwardly and outwardly with respect to the wheel 138. In particular, the two seal plates 146 along the sides of the aperture 144 are adjusted to within about 0.002 inches of the side edges 142 of the wheel 138, while the seal plates 146 at the upper and lower end of the aperture 144 are beveled to conform to the contour of the peripheral surface 140 and are likewise adjusted to within 0.002 inches of that surface. The peripheral surface 140 of the transfer wheel 138 projects slightly beyond the seal plates 144.

The ink transfer wheel 138 is preferably machined from stainless steel, and its peripheral surface 140, while being cylindrical, contains a multitude of minute pockets for holding the ink. Preferably about 6000 pockets 146 exist per square inch on the peripheral surface 140, and each pocket is generally circular and is about 0.003 inches deep and 0.005 inches wide. However, 3000 to 10,000 pockets may exist per square inch with each pocket being between 0.002 and 0.005 inches deep and 0.002 and 0.008 inches wide. One method of forming the pockets is to peen the surface 140 with an oscillating implement having a very small and sharp point formed from an extremely hard material such as tungsten carbide. As the implement oscillates, the wheel 138 is rotated and moved laterally, with the rotation and lateral movement continuing until the pockets extend over the entire surface 140. The pockets are thus arranged uniformly over the peripheral surface 140. Since the peening tends to raise the metal around the pockets, the surface 140 is thereafter dressed, preferably by grinding.

The opposite end of the shaft 138 projects into the cavity in the housing 2 which is formed by the rear wall 16, and this end of the shaft 138 is fitted with a pulley 150 (FIG. 3) which aligns with the other pulley 36, 54, 98 and 134.

Also, within the interior of the case 102 is a squeegee wheel 152 (FIGS. 5 and 7) which bears against the ink pick-up wheel 132 to squeeze excess ink off of it. The squeegee wheel 152 is mounted on a pivot arm 154 which pivots about a pin 156 threaded into the end wall 104 of the case 102. The pivot arm 154 is urged away from the adjacent portion of the peripheral wall 106 by a light compression spring 158, and this causes the squeegee wheel 152 to bear against the pick-up wheel 132. The squeegee wheel 152 is also formed from a suitable plastic such as Delrin.

The lower portion of ink transfer wheel 138 is wiped by a doctor blade 160 (FIGS. 5 and 7) which removes excessive ink from the surface 140 and further distributes the ink uniformly over that surface. In addition, the doctor blade 160 wipes the planar side edges 142 of the wheel 138. The doctor blade 160 pivots about a pivot pin 162 which is threaded into the end wall 104 and is urged into contact with the wheel 138 by a compression spring 164.

The entire inking unit 100 is urged toward the printing wheel 46 by loading rod 166 (FIG. 5) which extends through the side wall 8 and is pressed against the adjacent portion of the peripheral wall 106 on the seal case 102 by a coil-type compression spring 168 encircling the rod 166. The rod 166 is provided with a knob 170 to withdraw it against the force exerted by the spring 168. This removes the spring load on the inking unit 100.

Furthermore, the inking unit 100 has a positioning lever 172 attached to the uppermost portion of the peripheral wall 106, and this lever extends upwardly past the deflecting cam 86 (FIG. 1) on the cam shaft 82. In this regard, the cam 86 is positioned on the shaft 82 such that when the shaft 82 is in its operating position (FIGS. 1 and 4) the cam 86 is away from the lever 172, but when the shaft 82 is rotated to its release position (FIG. 5), the deflecting cam 86 bears against the positioning lever 172, urging it toward the sidewall 8. This will cause the entire ink unit 100 to pivot about the common axis of the boss 122 and bore 126 in which it is contained. As a result, the sealed case 102 moves against the force exerted by the rod 166 and the ink transfer wheel 138 moves away from the raised characters 52 on the printing wheel 46 so that a space exists between the two. The positioning lever 172 terminates at a beveled surface 172 located directly below the end off a positioning screw 176 which is threaded into the top wall 10 of the housing 2. The inclination of the beveled surface 172 is such that when the screw 176 is turned downwardly, the lever 172 is cammed toward the sidewall 8, causing the sealed case 102 to move against the force exerted on it by the loading spring 168.

All of the pulleys 36, 54, 89, 134 and 150 are of the timing variety, that is, they are grooved to resemble spur gears, and trained around these pulleys is a timing belt 178 (FIG. 3) having notches which fit into the grooves of the pulleys. These notches are on both faces of the belt 178. When the operating lever 88 is in its operating position, the timing belt 178 is taut (FIG. 3). In this position the crank arm 90 is slightly over center and the downwardly directed force exerted on the idler pulley 98 by the belt 178 is resisted by the stop **89*a*, against which the operating lever 88 bears. However, when the lever 88 is in its release position, the idler carrier 92 and its pulley 98 are depresssed (FIG. 6), imparting slack to the belt 178. In this condition, the forces exerted by the springs 62 and 72 on the roller carriers 58 and 68, act through the elevating cam 80 and cam shaft 82 to urge the operating lever 88 against the other stop 89*b*.**

The diameters of the pulleys 36, 54, 134 and 150 are all such that the drive wheel 34, the printing wheel 46, the ink pick-up wheel 132, and the ink transfer wheel 138 have the same peripheral velocity which equals the velocity of the banding B passing through the channel 26.

OPERATION

To prepare the printing machine A for operation, the operating lever 88 on the cam shaft 82 is rotated to the stop **89*b*, that is to the release position (FIG. 5). This causes the cam 80 to elevate the roller carriers 58 and 68 which in turn lifts the pressure rollers 56 and 66 away from the drive wheel 34 and printing wheel 46, respectively. The cam shaft 82 further moves the deflecting cam 86 against the positioning lever 172 of the ink unit 100, and this rotates the entire ink unit 100 away from the printing wheel 46 so that a space exists between the ink transfer wheel 138 of the inking unit 100 and the printing wheel 46.**

The printing wheel 46 may now be removed and replaced with another if desired. This is accomplished, by merely removing the thumb nut 48 and pulling the printing wheel 46 off of the shaft 38. Another printing wheel 46, which differs only in the raised characters 52 around its periphery, is fitted onto the shaft 38, engaged with the locating pins 44, and secured in place with the thumb nut 48.

Although, the rotating of the cam shaft 82 to its release position further causes the crank arm 90 on the rear end of the shaft 82 to move over center and downwardly, and thereby lower the idler carrier 92, the idler pulley 98 on it is not lowered sufficiently to cause the belt 178 to fall off of the pulleys 36, 54, 98, 134 and 150.

While the roller carriers 58 and 68 and the pressure rollers 56 and 66 thereon are still elevated, the banding B is inserted into the elongated aperture 20 in the sidewall 8, and then through the channel 26 between the guide strips 22 within the housing 2. The upper guide strip 22 may have to be adjusted laterally with respect to the lower guide strip 22, to accommodate banding B which is different in width than that previously used in the machine A. This adjustment is made merely by loosening the screws 23 and moving the upper strip 22 to the proper position, whereupon the screws 23 are again tightened. The banding B leaves the machine A through the elongated aperture 20 in the other sidewall 6.

Once the banding B is threaded through the channel 26, the operating lever 88 for the cam shaft 82 is rotated in the opposite direction back to the stop **89*a* which is the operating position (FIG. 1). This withdraws the elevating cam 80 from the finger 64 on the roller carrier 58, and enables the spring 62 to force the pressure roller 56 against the banding B. In effect, the banding B is compressed between the drive wheel 34 and the pressure roller 56. The finger 78 on the other roller carrier 68 is also released so that the spring 72 urges the pressure roller 66 downwardly to a position where it too will bear against the banding B. However, the adjusting screw 74 restrains the pressure roller 66 and prevents it from forcing the banding B too deeply into elastomeric raised characters 52 on the printing wheel 46. In addition to the foregoing, the deflecting cam 86 on the cam shaft 82 releases the positioning lever 172 and permits the spring loaded rod 166 to rotate the entire inking unit 100 toward the printing wheel 46. As a result, the peripheral surface 140 of the ink transfer wheel 138 comes against the raised characters 52 on the printing wheel 46, but the screw 176, which bears against the beveled surface 174 of the positioning lever 172 prevents the ink transfer wheel 138** from embedding too deeply in the raised characters 52. Finally, the rotation of the cam shaft 82 moves the crank arm 90 back over center, and this elevates the idler carrier 92 (FIG. 3) and the idler pulley 98 on it, which in turn tightens the belt 178. The stop 89*a* against which the operating lever 88 bears prevents the taut belt 178 from rotating the crank arm 90 still further beyond top center.

Next, the valve 118 is opened so that the reservoir 114 is provided with a supply of the quick drying ink. The ink level may be checked through the port 110, and once it reaches the level of the slot 116 in the bottom of the sealed case 102 the valve 118 is closed. In the alternative, the reservoir may be filled through the port 110. The plug 112 is, of course, replaced imediately to prevent the ink from evaporating.

When the banding B is drawn through the machine A, it causes the knurled drive wheel 34 to rotate by reason of the fact that the banding B is pressed firmly against the drive wheel 34 by the pressure roller 56. Since the drive wheel 34 is connected through the belt 178 with the printing wheel 46, as well as with the ink pick-up wheel 132 and ink transfer wheel 138 of the inking unit 100, those wheels also rotate. Moveover, the wheels 34, 46, 132 and 138 all have the same peripheral velocity which is the velocity of the banding B.

As the ink pick-up wheel 132 rotates through the supply of quick drying ink in the reservoir 114, the ink wets its surface and adheres thereto. The squeegee wheel 152, which bears against the periphery of the pick-up wheel 132, removes much of this ink, in effect squeezing it off of the wheel 132. The ink which remains is transferred to the ink transfer wheel 138 where the peripheries of the two wheels are in juxtaposition. Actually, the pick-up wheel 132 lays a relatively narrow bead of ink onto the peripheral surface 140 of the transfer wheel 138, and this bead is spread uniformly across the peripheral surface 140 at the doctor blade 160. Moreover, the doctor blade 160 removes much of the ink so that which remains is confined primarily to the minute pockets. Beyond the doctor blade 160, the peripheral surface 140 of the transfer wheel 138 passes through the rectangular aperture 144 in the peripheral wall 106 of the sealed case 102 and likewise past the seal plate 146 at the lower margin of that aperture. At this point, the ink first becomes exposed to the atmosphere.

Since the exposed portion of the transfer wheel 138 bears against the raised characters 52 on the printing wheel 46, the ink on the transfer wheel 138 is transferred to those characters 52. Actually, the elastomeric characters 52 to a limited extend deform into the pockets and withdraw the ink therefrom. Shortly beyond the exposed portion of the ink transfer wheel 138, the raised characters 52 on the printing wheel 46 press against the banding B, leaving the configurations of the characters 52 on the banding B.

The amount of ink imparted to the raised characters 52 is varied by turning the screw 176 which controls the position of the inking unit 100. On the other hand, the amount the raised characters 52 are compressed by the banding B is varied by turning the adjusting screw 74. Thus, both the adjusting screws 74 and 176 determine the quality of the print imparted to the banding B.

The ink is exposed to the atmosphere for only about 90° of rotation for the printing wheel 46, and under normal operating conditions the wheel rotates 90° in substantially less time than the drying time for the ink. Thus, the ink is transferred to the banding B, on which is completely dries shorty after leaving the elongated aperture 20 in the sidewall 116 of the housing 2. Note that the channel 26 for the banding B is completely open in the downward direction beyond the wheel 46 to prevent smearing the ink as it dries. The fact that the printing wheel 46 moves at the same velocity as the tape B also prevents smearing. The ink does not dry within the sealed case 102 of the inking unit 100 since the seal plates 148 form a vapor barrier with the ink transfer wheel 138 at the only opening in the seal case 102.

The inking unit 100 may be removed from the housing 2 by turning the cam shaft 82 to its release position and removing the belt 178 from the pulleys 134 and 150. Then the locking tab 129 is moved upwardly to free the pivot boss 122 on the seal case 102. Thereafter, with the loading rod 166 withdrawn, the inking unit 100 is pulled from the housing 2. This facilitates cleaning of the inking unit 100. Furthermore, it enables the inking unit 100 to be replaced by another containing an ink of different color.

This invention is intended to cover all changes and modifications of the example of the invention herein chosen for purposes of the disclosure which do not constitute departures from the spirit and scope of the invention.

What is claimed is:

1. In a machine for printing letters, numbers, symbols, and the like on elongated material and including a base structure, a printing wheel on the base structure and being rotatable with respect to it, the printing wheel having raised characters along the periphery thereof, and means for urging the elongated material against the periphery of the printing wheel, an improved inking unit for applying ink to the raised characters on the printing wheel, said inking unit comprising: a sealed case mounted on the base structure for pivotal movement about a pivot axis; an ink reservoir on the case and opening upwardly into the interior of the case for containing a supply of liquid ink; an ink transfer wheel in the case remote from the reservoir and having a peripheral surface, a small portion of the ink transfer wheel being projected through a case with the peripheral surface at said small portion being in contact with the raised characters on the printing wheel, the ink transfer wheel being rotatable in the case about an axis which is offset from the pivot axis of the case such that the peripheral surface of the transfer wheel will move toward or away from the printing wheel as the case pivots about its pivot axis; seal means on the case where the transfer wheel emerges from the case for isolating the interior of the case from the surrounding atmosphere; an ink pick-up wheel mounted in the case for rotation about an axis which is coincident to the pivot axis for the case whereby the spacing between the ink pick-up wheel and the printing wheel does not vary irrespective of the angular position of the case, the ink pick-up wheel projecting into the ink reservoir so as to pick up ink on the periphery thereof, the ink pick-up wheel passing close enough to the ink transfer wheel within the case to transfer ink to the periphery of the ink transfer wheel, whereby the ink will be transferred to the raised characters and thence to the elongated material in the configuration of the raised characters; and means for driving the ink pick-up wheel, the ink transfer wheel and the printing wheel all at substantially the same peripheral velocity.

2. The structure according to claim 1, and further comprising means for maintaining the pivoted case in a fixed angular position within the base structure.

3. The structure according to claim 1 wherein the peripheral surface of the wheel contains a multitude of small pockets in which the ink is contained and the raised characters are formed from an elastomeric material.

4. The structure according to claim 3 and further comprising a doctor blade within the sealed case and bearing against the peripheral surface of the ink transfer wheel to remove excessive ink from the peripheral surface and to spread the ink uniformly across the peripheral surface.

5. The structure according to claim 3 and further comprising a doctor blade within the sealed case and bearing against the peripheral surface of the ink transfer wheel between the location where the ink pick-up wheel applies ink to the peripheral surface of the ink transfer wheel and the location where the peripheral surface emerges from the sealed case.

6. In a machine for printing letters, numbers symbols, and the like on elongated material and including a base structure, a printing wheel on the base structure and being rotatable with respect to it, the printing wheel having raised elastomeric characters along its periphery, and means for urging the elongated material against the raised characters of the printing wheel, an improved inking unit for applying ink to the raised characters on the printing wheel, said inking unit comprising: a sealed case mounted on the base structure; a source of liquid ink on the case; a rotatable ink transfer wheel in the case remote from the source of ink and having a hard and smooth peripheral surface and a multitude of individual and separated minute pockets arranged generally uniformly in an opening out of the peripheral surface, a small portion of the ink transfer wheel being projected through the case with the peripheral surface at that small portion being in contact with the raised characters on the printing wheel; seal means on the case for isolating the interior of the case from the surrounding atmosphere where the ink transfer wheel emerges from the case; a rotatable ink pick-up wheel mounted in the case such that is passes by the source of liquid ink and ink from the source is deposited on the periphery of the pick-up wheel, the ink pick-up wheel and the ink transfer wheel being spaced slightly apart at their peripheries, but the ink pick-up wheel having its periphery sufficiently close enough to the periphery of the ink transfer wheel to enable the ink to transfer from the pick-up wheel to the peripheral surface of the ink transfer wheel; and a doctor blade in the case and bearing against the smooth peripheral surface of the ink transfer wheel beyond the location at which pick-up wheel deposits ink on the transfer wheel and before the location at which the ink transfer wheel emerges from the case, the doctor blade removing ink from the peripheral surface such that the ink which remains beyond the doctor blade is confined primarily to the minute pockets, whereby the ink which remains in the pockets of the ink transfer wheel will be transferred to the raised characters on the printing wheel and thence to the elongated material in the configuration of the raised characters.

7. The structure according to claim 6 wherein the maximum spacing between the peripheries of the pick-up wheel and the ink transfer wheel is about 0.0010 inches.

8. The structure according to claim 6 wherein the source of liquid ink is an ink reservoir mounted on the case and opening into the interior of the case, the ink reservoir containing a supply of liquid ink; and wherein the ink pick-up wheel projects into the ink reservoir.

9. The structure according to claim 8 and further comprising a squeegee wheel bearing against the ink pick-up wheel between the location where the ink pick-up wheel passes through the reservoir and the location where the ink pick-up wheel passes in juxtaposition to the ink transfer wheel, whereby some ink is removed from the ink pick-up wheel.

10. The structure according to claim 6 wherein each said wheel is connected with a pulley located on the same axis as the wheel and a belt extends over all the pulleys, the pulleys being sized so that the wheels all rotate at the same peripheral velocity.

11. The structure according to claim 6 in which the pockets are between about 0.002 and 0.005 inches deep and between about 0.002 and 0.008 inches wide.

12. The structure according to claim 11 wherein between 3000 and 10000 pockets exists per square inch of the peripheral surface of the ink transfer wheel.

13. The structure according to claim 6 wherein the ink transfer wheel is between about 6 and 10 times as wide as the peripheral surface of the ink pick-up wheel so that the ink is applied to the ink transfer wheel as a narrow bead.

14. The structure according to claim 6 and further comprising synchronizing means connecting the printing wheel, the ink transfer wheel, and the pick-up wheel for rotating those wheels in unison such that they all have the same peripheral velocity.

15. The structure according to claim 6 wherein the machine further comprises a drive wheel against which the material is forced such that the drive wheel is rotated as the material moves through the machine, and means coupling the drive wheel with the printing wheel, the ink transfer wheel and the pick-up wheel such that all of the wheels rotate at angular velocities at which their peripheral velocities are the same.

16. The structure according to claim 6 wherein the sealed case pivots about the axis of the ink pick-up wheel so that the force with which the raised characters bear against the peripheral surface of the ink transfer wheel may be varied.

* * * * *